US005513750A

United States Patent [19]

Rychel

[11] Patent Number: 5,513,750

[45] Date of Patent: May 7, 1996

[54] ROLLER BLADE WHEEL CADDY

[76] Inventor: Gerald E. Rychel, 2926 Reppuhn Dr., Saginaw, Mich. 48603

[21] Appl. No.: 229,319

[22] Filed: Apr. 18, 1994

[51] Int. Cl.[6] ..... B65D 85/20

[52] U.S. Cl. ..... 206/315.1; 206/564; 206/303; 206/459.5

[58] Field of Search ..... 206/315.1, 372, 206/373, 564, 303, 304, 459.5

[56] References Cited

U.S. PATENT DOCUMENTS

| | | | |
|---|---|---|---|
| D. 287,548 | 1/1987 | Kraynakc-Simon | D3/36 |
| 1,135,281 | 4/1915 | Hawkins . | |
| 1,653,967 | 12/1927 | Paulson . | |
| 2,130,762 | 9/1938 | Borden | 273/148 |
| 2,292,721 | 4/1943 | Stanton | 211/49 |
| 3,540,576 | 11/1970 | Pierce et al. | 206/303 |
| 3,712,465 | 1/1973 | Deuschle | 206/459.5 |
| 3,905,506 | 9/1975 | Florian | 206/564 |
| 3,934,733 | 1/1976 | Worden | 214/1 |
| 4,382,733 | 5/1983 | Rodgers | 410/49 |
| 4,572,371 | 2/1986 | Asenbauer | 206/459.5 |
| 4,842,134 | 6/1989 | Chang | 206/315 |
| 4,896,612 | 1/1990 | Salloum | 108/55 |
| 5,071,004 | 12/1991 | Rivera | 206/372 |
| 5,145,064 | 9/1992 | Chen | 206/372 |
| 5,209,352 | 5/1993 | Light et al. | 206/564 |

*Primary Examiner*—Paul T. Sewell
*Assistant Examiner*—Tara L. Laster
*Attorney, Agent, or Firm*—John J. Swartz

[57] ABSTRACT

A roller blade wheel caddy including a plurality of stations for individually storing a plurality of disassembled roller blade wheel assemblies each including a roller blade wheel, a pair of roller blade bearings for rotatably mounting the wheel on a shaft, and a tubular bearing spacer for axially spacing the bearings on the shaft. Each of the stations includes a wheel well of a predetermined magnitude for receiving a wheel, an associated wheel bearing well which has a substantially reduced magnitude, and an associated spacer storage member for storing the spacer associated with the wheel. Indicia is provided for indicating a predetermined rotational sequence for the roller blade assemblies. A wheel assembly peg is provided for use in assembling the parts and a storage well is also provided for storing miscellaneous parts.

12 Claims, 3 Drawing Sheets

56
52
26
44
48
28
26
58
42
70
72
46
60
68
64
66
54
50
68
42
40
70
74
58
60
66
34
56
10
47

FIG. 5 (PRIOR ART)
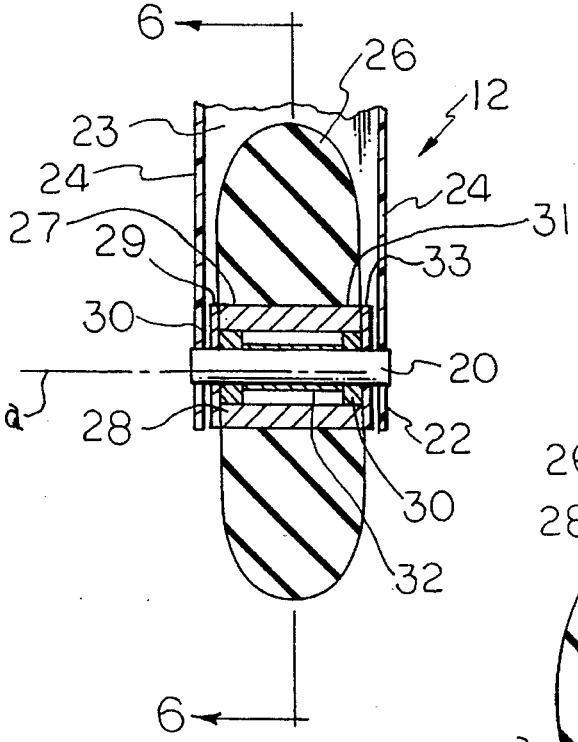
FIG. 6 (PRIOR ART)
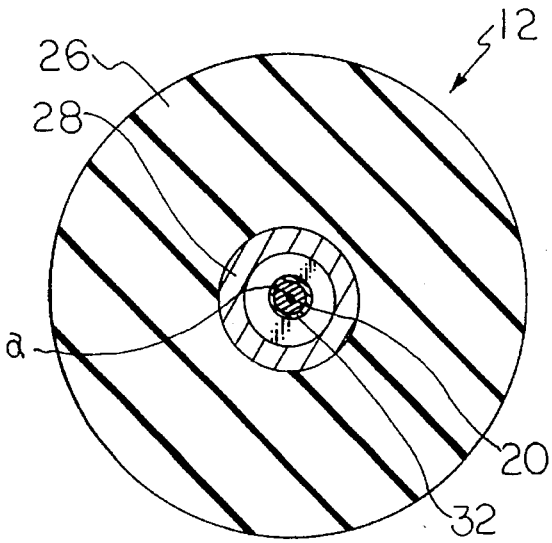
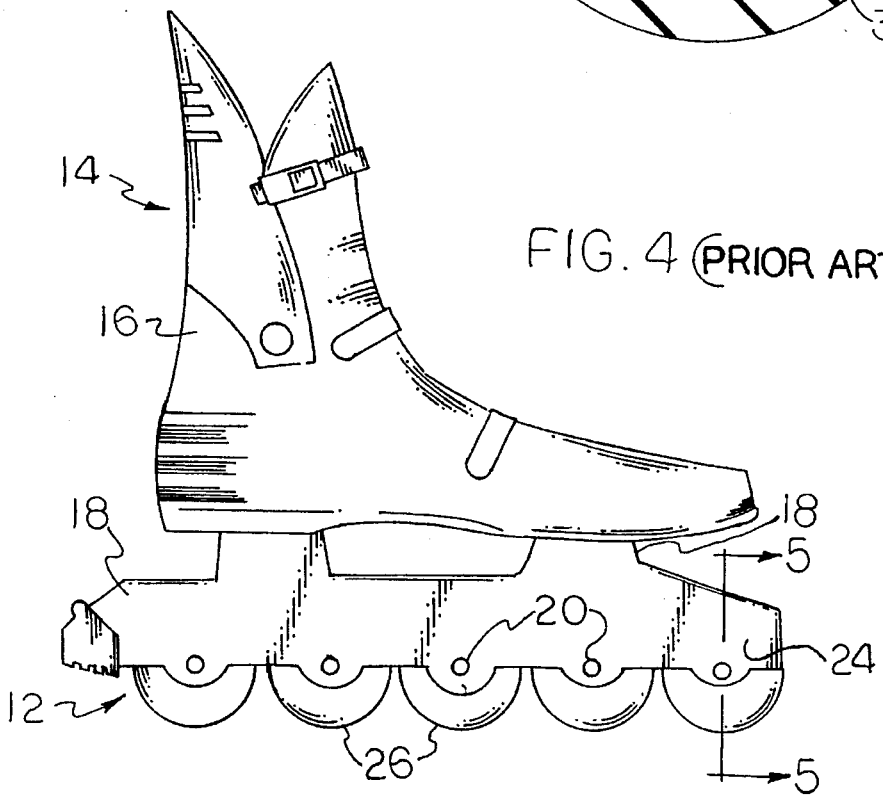
FIG. 4 (PRIOR ART)

ROLLER BLADE WHEEL CADDY

BACKGROUND OF THE INVENTION

1. Field of the Invention

This invention relates to a storage caddy for roller blade wheel assemblies and more particularly, to a roller blade wheel caddy which has storage facilities for individually storing components of disassembled roller blade wheel assemblies in individual sets.

2. Description of the Prior Art and Objects

Skating is a form of pleasure and recreation which, depending on the skate utilized, can be accomplished in the winter as well as the summer. Typically, ice skate include a shoe fitted with a runner mounting a blade which can be sharpened for digging into the ice. Roller skates have typically included four wheels or rollers, instead of a runner and/or blade, for use on a sidewalk or other surface. For many years, each roller skate included two forward wheels and two rearward wheels. In recent years, a new type of roller skate, sometimes referred to as a "roller blade", was developed and includes a shoe mounted on a runner which, instead of a sharpened blade, mounts a plurality of longitudinally aligned roller wheel assemblies. Racing skates typically each incorporate a blade rotatably mounting five longitudinally aligned roller blade wheel assemblies. Each roller blade wheel assembly includes a roller blade wheel which is rotatably mounted on a blade mounted shaft via a pair of axially spaced apart bearings that are held in axially spaced relation by a tubular spacer that is received on the shaft.

The wheel assemblies must be periodically disassembled, cleaned, and rotated through a predetermined rotational sequence to ensure even wear of the roller wheel and thus maximize operating performance.

It is important to keep the component parts of each wheel assembly together throughout the rotational sequence. Heretobefore, when the plurality of wheel assemblies were removed from the blade and cleaned, the users frequently were unable to keep the component parts of each various wheel assemblies isolated and separated from the component parts of the other wheel assemblies. Instead, parts from different sets of wheel assemblies would be intermingled with the parts from the other wheel assemblies, thus decreasing the optimum performance which is important to "roller bladers", particularly those who are racers. Accordingly, it is an object of the present invention to provide a storage facility for storing individual disassembled components of a plurality of roller blade wheel assemblies of a roller blade skate.

Another object of the present invention is to provide a portable roller blade wheel caddy for storing the individual components of a roller blade skate in individual compartments for each wheel assembly.

Still another object of the present invention is to provide a roller blade caddy including a plurality of storage compartments each including a plurality of individual storing members for individually storing a plurality of disassembled component parts of each wheel assembly in individual clusters.

Yet another object of the present invention is to provide a roller blade wheel caddy including a plurality of storage compartments equal in number to the number of roller blade assemblies provided on a pair of roller blade skates.

A further object of the present invention is to provide a roller blade wheel caddy which includes a plurality of side-by-side storage compartments for individually storing a plurality of sets of dismantled wheel assemblies and indicia for indicating a predetermined rotational sequence for the individual wheel assemblies.

A still further object of the present invention is to provide a roller blade wheel caddy of the type described including a plurality of individual storage compartments, each compartment including an upwardly opening wheel well of a predetermined depth for storing a roller blade wheel, a wheel bearing well, having a reduced depth, for storing the wheel bearings associated with the wheel stored in the wheel well, and an upstanding peg for storing the bearing spacer associated with the wheel bearings stored in the wheel bearing well.

It is yet another object of the present invention to provide a roller blade wheel caddy of the type described further including an assembly peg on which the various dismantled component parts can be assembled.

Other objects and advantages of the present invention will become apparent to those of ordinary skill in the art as the description thereof proceeds.

SUMMARY OF THE INVENTION

A roller blade wheel caddy for storing a plurality of dismantled wheel assemblies each including a roller blade wheel, a set of bearings and a spacer, said caddy comprising: a plurality of wheel storage stations, equal in number to the number of wheel assemblies to be stored; each station including a wheel well of a predetermined magnitude for receiving and storing a roller blade wheel; a wheel bearing storage well, having a lesser predetermined magnitude and disposed adjacent the wheel storage well for storing wheel bearings associated with the wheel stored in the wheel well; and a spacer storage area disposed adjacent one of the wheel storage well or the wheel bearing storage well for storing a tubular spacer associated with the bearings stored in the wheel bearing storage well.

DESCRIPTION OF THE DRAWINGS

The invention may be more readily understood by referring to the accompanying drawings, in which:

FIG. 4 is a side elevational view of a typical prior art roller blade skate including a plurality of individual roller blade wheel assemblies;

FIG. 5 is a greatly enlarged sectional end view of a roller blade wheel assembly, taken along the line 5—5 of FIG. 4; and FIG. 6 is a sectional side view of a roller blade wheel assembly, taken along the line 6—6 of FIG. 5.

DESCRIPTION OF THE PREFERRED EMBODIMENT

Figure 1:
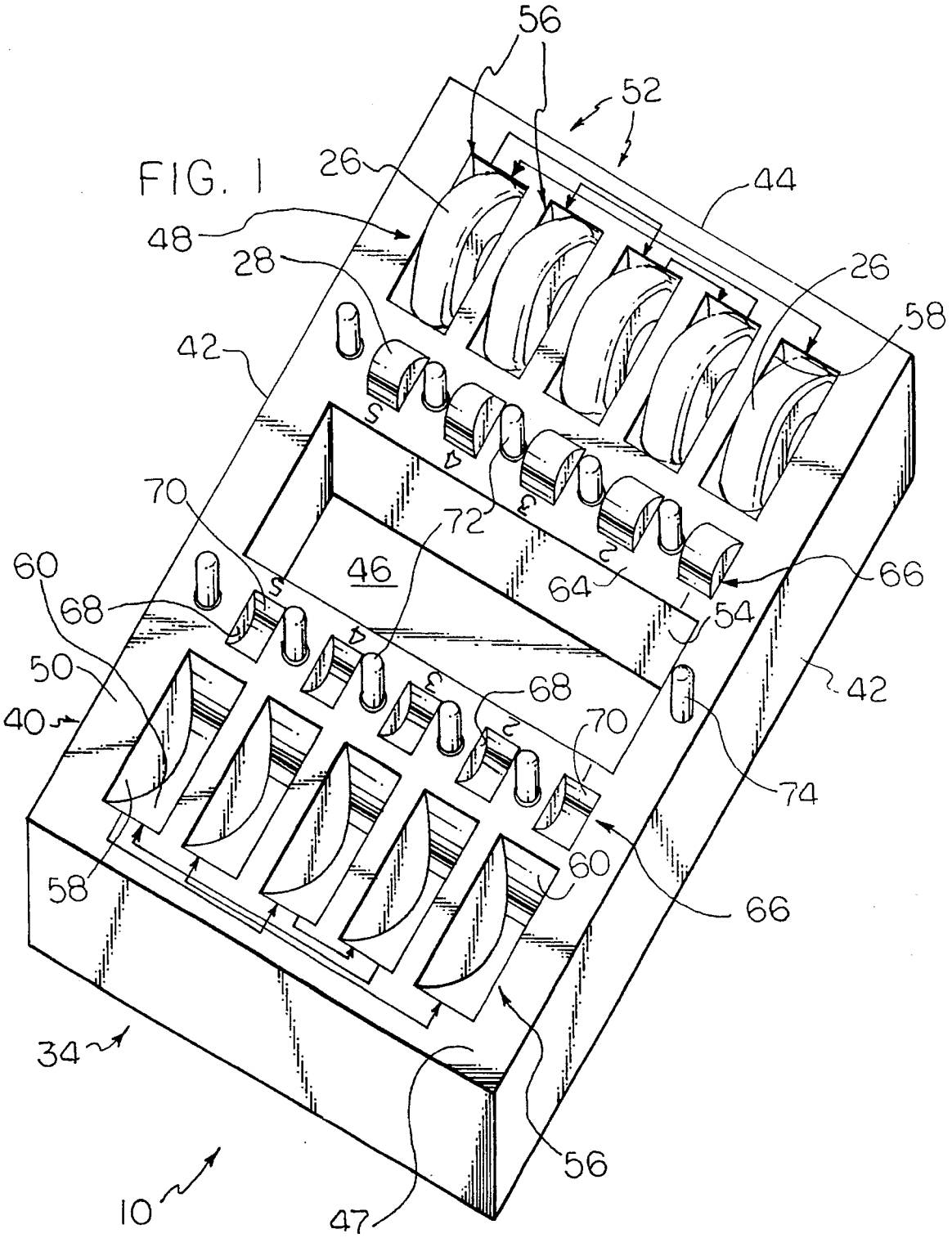
FIG. 1 is a perspective view of the lower half of a roller blade wheel caddy constructed according to the present invention.

The apparatus, generally designated 10, constructed according to the present invention, is particularly adapted for use in storing a plurality of wheel blade assemblies, generally designated 12, provided on a pair of roller blades skates, one of which is generally designated 14 in FIG. 4. The roller blade skate 14 typically includes a shoe 16 mounted on an elongate, generally vertical runner or blade 18 which serially mounts the roller blade wheel assemblies 12, via shafts 20, in longitudinally spaced relation. The wheel assemblies 12 are received in a downwardly opening, elongate trough 23 defined by laterally spaced apart, bifurcated rails 24 (FIG. 5) provided on the lower edge of each skate runner 18. The longitudinally spaced apart shafts 20 typically span the lower ends 22 of a downwardly opening bifurcated rails 24 of the runner 18.

Each wheel assembly 12 includes a solid roller blade wheel 26, which may suitably comprise polyurethane, mounted on an annular, cylindrical rim 28 that is journaled on a shaft 20 by a pair of axially spaced apart bearings 30 which are held in axially spaced relation on the shaft 20 by a hollow cylindrical spacer or tube 32 which is rotatably received on the shaft 20 and is coaxial with the axis a of shaft 20. To retain lubricant and to keep out dirt, one end 27 of each rim 28 is closed by a shaft receiving, permanent seal 29 and the opposite end 31 of each rim detachably mounts a shaft receiving, removeable seal 33. To achieve even wear on the plurality of roller wheels 26, the wheel assemblies 12 are periodically removed from the runner blade 18, cleaned, and longitudinally interchanged with other wheel assemblies 12 on each skate.

It is important that the wheel 26 be mounted via the same set of bearings as it is rotated from position to position along the length of wheel blade or runner 18. The caddy 10, constructed according to the invention, stores the component parts of the wheel assemblies 12 when they are removed from the skate 14.

Figure 2:
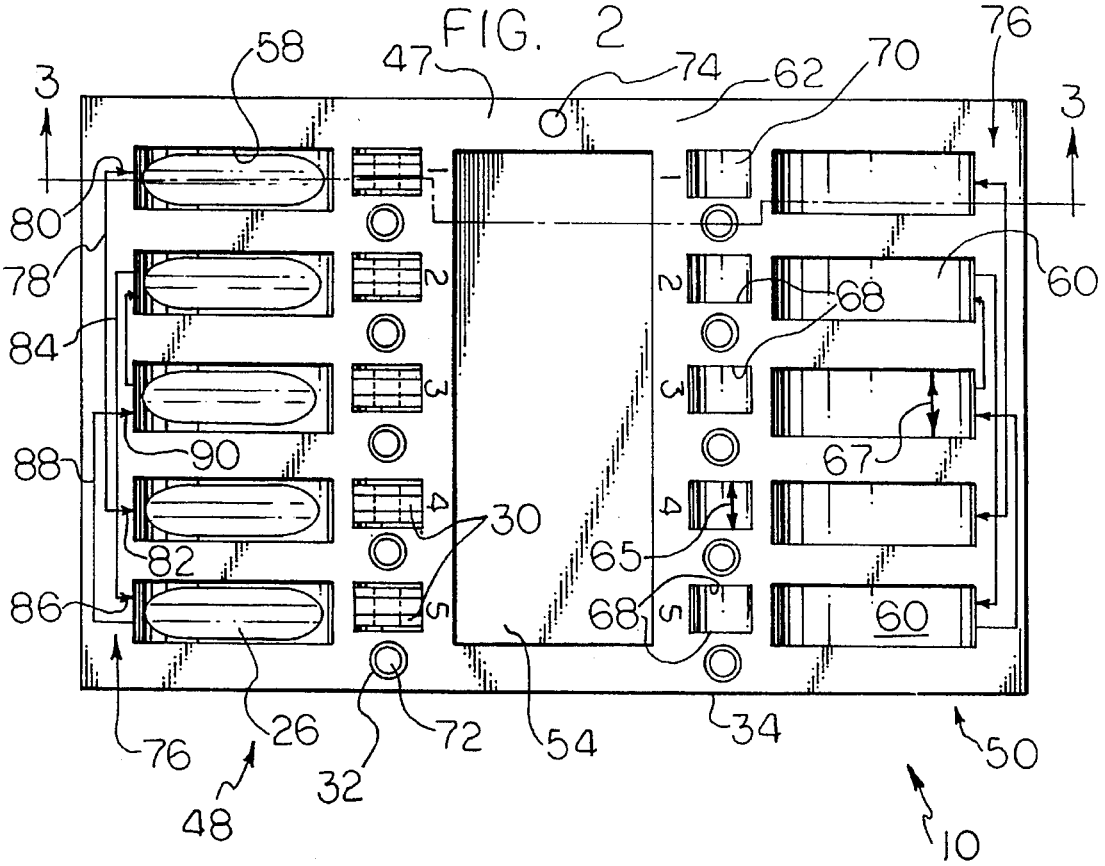
FIG. 2 is a top plan view of the lower half of the roller blade wheel caddy, generally taken along the line 2—2 of FIG. 3.
Figure 3:
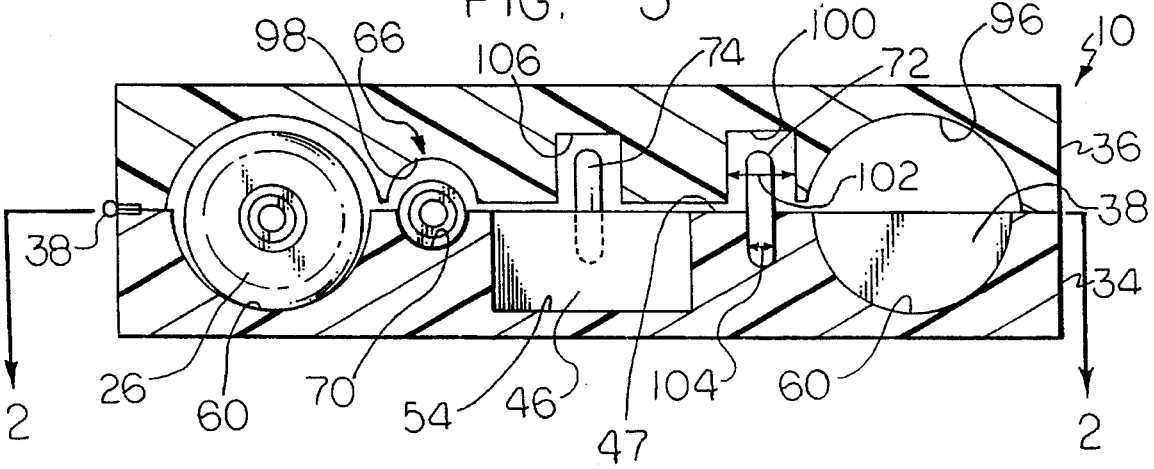
FIG. 3 is a sectional side view of the upper and lower halves of the roller blade wheel caddy, taken along the line 3—3 of FIG. 2, with the cover being illustrated in a closed, covering position.

The caddy 10 includes a lower storage container, generally designated 34, and an upper cover, generally designated 36, pivotally mounted the container 34 via a hinge assembly, generally designated 38 for swinging movement between a closed, container covering position, illustrated in FIG. 3, and a removed position in which the lower storage containiner is exposed as illustrated in FIGS. 1 and 2. The lower storage container 34 includes a frame, generally designated 40, which has laterally spaced apart side walls 42 spanned by longitudinally spaced apart end walls 44, a bottom wall 46 and a top wall 47. If desired, the entire lower storage container 34 may comprise a one-piece integrally molded plastic.

The lower storage container 34 includes a pair of longitudinally spaced apart parallel rows, generally designated 48 and 50, of individual storage compartments or stations, generally designated 52, on longitudinally opposite sides of an upwardly opening, central storage cavity or well 54 which is provided in the top wall 47. Each row 48, 50 includes a plurality of laterally spaced apart storage stations 52. Tools, cleaners, wrenches and miscellaneous parts of the wheel assemblies, such as the seals 33, can be stored in the storage well 54.

Each of the storage compartments, generally designated 52, includes an upwardly opening, longitudinally extending, semicircular, wheel storage well 56 which is parallel to each other laterally adjacent wheel storage well 56 in the respective row 48 and 50. Each well 56 has parallel sides 58 and a semi-cylindrical bottom wall 60 defining the well 56. There are five wells 56 in row 48 for receiving one each of the five roller blade wheels 26 on one skate and five roller blade wheel wells 56 in row 50 for receiving the five roller blade wheels on the other skate.

Indicia, generally designated 62, including the numerals 1, 2, 3, 4, 5, are provided on the top frame wall 64 corresponding to the position of the roller assemblies 12 on the skate 14 from front to rear. As is illustrated, the "number 1" well for each blade is in opposing alignment with the "number 1" well for the other skate of each pair of skates.

The numbers "1–5" provided with indicia 62 designate the wheel assembly stations from front to rear on the roller skate.

Each of the storage compartments or stations 52 also includes an upwardly opening, wheel bearing storage well, generally designated 66, defined by longitudinally extending laterally spaced apart side walls 68, and a semi-circular bottom wall 70 for receiving the bearings 30 on which the associated wheel is mounted on the shaft 20. The walls 68 of each wheel bearing well 66 are parallel to the side walls 68 of each other well 66 provided in the row 48 or 50. As illustrated, the magnitude of the wheel bearing well 16 is substantially less than the magnitude of the wheel well 56.

The walls 68 of each wheel bearing well 66 are laterally spaced a distance 65 which is substantially less than the distance 67 between the wheel well walls 58. Also provided on the top wall 47 at each station 52 is an upstanding cylindrical spacer storage peg 72 which receives the tubular spacer 32 when it is removed from the assembled wheel. In this way, the component parts, including the roller blade wheel 26, the bearings 30, and the spacer 32 associated with each wheel assembly 12, are kept in a cluster and not intermingled with other removed wheels, bearing spacers, and wheel bearings.

An assembly peg 74 is provided on the top wall 47 adjacent one lateral side of the central storage well 54 and is generally identical to the pegs 72. The peg 74 is located a sufficient distance from the nearest spacer storage pegs 72 that an entire wheel assembly 12 may be assembled thereon without interfering with the storage of bearing spacers 32 on the spacer pegs 72.

Also provided on the top wall 47 is rotating indicia, generally designated 76, provided at each end 44 of the frame 40 for indicating the proper rotational sequence of the wheel assemblies 12 for each skate 14. The rotating indicia 76 includes an indicia line 78 extending laterally from the number 1 wheel storage well 56 to the number 4 storage well 56 with indicia arrows 80 and 82 provided on opposite ends thereof adjacent and pointed towards the number 1 and number 4 wheel wells indicating that the number 1 wheel and the number 4 wheel assemblies 12 are to be interchanged.

The rotating inidicia 76 also includes an indicia line 84 extending laterally from the number 2 wheel well to the number 5 wheel well and provided with an indicia arrow 86, adjacent and pointed toward station 4 well, which indicates to the user that the wheel assembly 12 at station 2 is rotated sequentially to the station 4.

The rotating indicia 76 also includes a line 88, laterally extending from the number 5 station to the number 3 station, including an indicia arrow 90, adjacent and pointed toward the number 3 station, indicating that the wheel assembly 12 at station 5 is rotated sequentially to station 3.

Typically, wheel assemblies 12 will be assembled one at a time by placing one of the bearings 30 from each wheel assembly set into one end 27 of the rim 28 to be firmly seated therein and then placing the partially assembled wheel on the locating assembly peg 74 with the rim end 27 being lowermost on the peg 74. The associated spacer 32 is then removed from the storage peg 72 and placed on the assembly peg 74 against the axially inner side of the bearing 30 on rim end 27. The opposite bearing 30, associated with the wheel assembly 12 being assembled, is then disposed into the opposite end 31 of the rim 28. The removeable seal 33 is then placed on the rim end 31 to seal the bearing end 31. The thus assembled wheel assembly 12 can then be removed from the assembly peg 74 and mounted in its proper position on the skate blade 18 corresponding to the position indicated by the indicia 76.

The cover 36 includes parallel rows of semi-cylindrical cavities 96, equal in number to the number of wheel assembly stations 12. The cavities 96 are disposed in the underside of cover 36, in opposing confronting relation with, the wheel well cavities 56 when the cover 36 is closed. The shape, size and configuration of the cavities 96 is substantially a mirror image of the shape, size and configuration, respectively, of the wheel wells 54. If desired, the wheel well cavities 56 can be slightly smaller than illustrated to conform to the outline or circumference of the wheels 26.

The cover 36 also includes a plurality of downwardly opening wheel bearing receiving wells 98 which are equal in number to, and in confronting relation with the wheel bearing wells 66 for receiving the upper half of the wheel bearings 30 disposed in the wheel bearing well 66 when the cover 36 is closed. The wheel bearing wells 98 are illustrated as being slightly smaller than the cover openings 98 and shaped to conform identically to the outer circumference of the lower half of each wheel bearing 30.

The radius of the downwardly opening wells is slightly larger than the radius of the wheel bearings 30 to allow the cover 36 to easily close without striking the top halves of the wheel bearings 30 stored therein.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A roller blade wheel caddy for storing a plurality of roller skate blade wheel assemblies for a roller blade skate, each assembly including a roller blade wheel, a pair of wheel bearings for rotatably mounting the wheel on a shaft, and a tubular bearing spacer for axially spacing said bearings on said shaft, said caddy comprising:

frame means having a plurality of spaced apart storage stations;

means on said frame means for storing said wheel, bearings and spacer of each of said roller skate assemblies in a group at one of said stations spaced from each other group of wheel, bearings, and spacer of each other roller skate assembly at each of said other stations including wheel storage means at each of said plurality of stations, having a predetermined physical magnitude for receiving and storing said roller blade wheels;

wheel bearing storage means, adjacent said wheel storage means, at each of said stations and having a lesser predetermined physical magnitude which is less than said predetermined physical magnitude, for receiving and storing said wheel bearing utilized to mount said roller blade wheel stored in said adjacent wheel storage means; and spacer storage means at each of said stations, disposed adjacent one of said wheel storage means and said wheel bearing storage means, for receiving and storing said tubular spacer utilized to space said bearings received by said wheel bearing storage means at each of said stations;

each of said wheel storage means comprising an upwardly opening wheel well having a predetermined depth and each of said upwardly opening wheel bearing storage means comprising an upwardly opening wheel bearing storage well of a lesser predetermined depth less than said predetermined breadth;

said spacer storage means comprising an upstanding peg adjacent one of said wheel well and said wheel bearing well at each of said stations.

2. The caddy set forth in claim 1 wherein each of said wheel wells has a contour adapted to receive at least a portion of one of said wheels.

3. The caddy set forth in claim 1 wherein said wheel storage means comprises a plurality of laterally spaced apart, upwardly opening, side-by-side wheel wells of a predetermined depth and a predetermined breadth at said plurality of stations, and further including an upstanding assembly peg on said frame on which said spacer, bearings and wheel at each of said stations may be sequentially assembled.

4. The caddy set forth in claim 1 further including an upwardly opening storage well for storing roller blade wheel assembly tools.

5. The roller blade caddy set forth in claim 1 wherein said plurality of wheel storage means are disposed in parallel rows.

6. The roller blade caddy set forth in claim 5 wherein the wheel storage means in each of said rows are equal in number to the number of wheel storage means in the other of said rows.

7. The roller blade caddy set forth in claim 6 including additional storage well means disposed between said parallel rows.

8. The roller blade caddy set forth in claim 1 including a cover for selectively covering and uncovering said wheel storage means, said wheel bearing storage means and said spacer storage means.

9. The roller blade caddy set forth in claim 8 wherein said plurality of wheel storage means comprises a plurality of laterally spaced apart, upwardly opening wheel receiving wells and said cover includes a plurality of downwardly opening, wells opposing said upwardly opening wells for covering said wheel.

10. The caddy set forth in claim 1 including indicia means on said frame for indicating a predetermined desired rotation sequence for rotating said roller blade wheel assemblies.

11. The roller blade caddy set forth in claim 1 wherein said plurality of wheel storage means are disposed in laterally spaced apart, side-by-side relation; said wheel bearing storage means are disposed in laterally spaced apart side-by-side relation, generally longitudinally aligned with said plurality of wheel storage means.

12. The roller blade caddy set forth in claim 11 wherein plurality of spacer storage means are disposed in laterally spaced apart, side-by-side relation generally longitudinally aligned with said plurality of wheel storage means.

* * * * *